US006473933B2

(12) United States Patent
Paterson et al.

(10) Patent No.: US 6,473,933 B2
(45) **Date of Patent: *Nov. 5, 2002**

(54) BELT-MOUNTED VACUUM APPARATUS AND METHODS

(75) Inventors: Christopher M. Paterson, Long Beach, MS (US); Paul A. Moshenrose, Ocean Springs, MS (US); William G. Fish, Gulfport, MS (US); James McCain, Long Beach, MS (US); Charles W. Reynolds, Long Beach, MS (US); Michael E. Embree, Providence, RI (US)

(73) Assignee: Oreck Holdings, LLC, Cheyenne, WY (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/013,174

(22) Filed: Dec. 7, 2001

(65) Prior Publication Data

US 2002/0050022 A1 May 2, 2002

Related U.S. Application Data

(63) Continuation of application No. 09/619,799, filed on Jul. 20, 2000, now Pat. No. 6,393,656.

(51) Int. Cl.[7] ..... A47L 5/36
(52) U.S. Cl. ..... 15/327.5; 15/352
(58) Field of Search ..... 15/327.5, 352

(56) References Cited

U.S. PATENT DOCUMENTS

| | | | |
|---|---|---|---|
| 1,047,164 | A | 12/1912 | Butenschoen |
| 1,255,662 | A | 2/1918 | Sullivan |
| 2,586,145 | A | 2/1952 | Breuer et al. |
| 3,331,090 | A | 7/1967 | Reiber et al. |
| 3,599,273 | A | 8/1971 | Shirayanagi et al. |
| 4,570,286 | A | 2/1986 | Ross |
| 4,748,712 | A | 6/1988 | DiGiovanni |
| 4,944,065 | A | 7/1990 | Svanberg et al. |
| 5,052,073 | A | 10/1991 | Iida |
| D326,747 | S | 6/1992 | Stickle |
| 5,195,208 | A | 3/1993 | Yamami et al. |
| 5,220,704 | A | 6/1993 | Flynn et al. |
| 5,267,371 | A | 12/1993 | Soler et al. |
| 5,588,177 | A | 12/1996 | Eriksen |
| 5,813,088 | A | 9/1998 | Wagner et al. |
| 5,836,046 | A | 11/1998 | Huffman et al. |
| 6,066,211 | A | 5/2000 | Sandell |
| 6,073,301 | A | 6/2000 | Berfield |
| 6,151,749 | A | 11/2000 | Berfield |

FOREIGN PATENT DOCUMENTS

| | | |
|---|---|---|
| EP | 0 362 169 A2 | 4/1990 |
| WO | 94/27485 | 12/1994 |

*Primary Examiner*—Chris K. Moore
(74) *Attorney, Agent, or Firm*—Faegre & Benson LLP

(57) ABSTRACT

Belt-mounted vacuum apparatus and methods are disclosed. In one embodiment, a belt-mounted vacuum apparatus includes a belt member adapted to engage about an operator's waist, a dirt receptacle attached to the belt member, and a vacuum unit attached to the belt member and spaced apart from the dirt receptacle. The vacuum unit is operatively coupled with the dirt receptacle such that an airflow created by the vacuum unit propels particulates through the intake port and into the dirt receptacle. In alternate embodiments, the vacuum unit may be spaced apart from the dirt receptacle by a small distance, or may be positioned on opposite sides of the operator. In another embodiment, an apparatus includes a belt member having a stiffened portion. The stiffened portion may, for example, comprise an outer shell. Alternately, the belt member may also include a flexible, padded layer that engages with the operator's waist. In yet another embodiment, an apparatus includes a belt member, a dirt receptacle attached to the belt member and located at an accessible location on the belt member, and a vacuum unit. The dirt receptacle may be located proximate a front side of the operator's waist, or along a left or right side of the operator's waist, or at any other accessible location on the belt member.

33 Claims, 5 Drawing Sheets

BELT-MOUNTED VACUUM APPARATUS AND METHODS

CROSS-REFERENCE TO RELATED APPLICATION

This application is a continuation of U.S. patent application Ser. No. 09/619,799, filed Jul. 20, 2000, and now U.S. Pat. No. 6,393,656.

TECHNICAL FIELD

The present invention relates to portable vacuum apparatus and methods, and more specifically, to belt-mounted vacuums.

BACKGROUND OF THE INVENTION

Portable vacuums that may be carried or worn by an operator have great utility in a variety of applications. For example, portable vacuums are often used in commercial settings for cleaning densely congested areas, such as office areas, hotels, theaters, and restaurants. They may also be used around the home for cleaning stairways, automobiles, or other living areas. A variety of portable vacuum styles are known, including "back pack " vacuums, shoulder-mounted vacuums, and belt-mounted vacuums.

FIG. 1 is an isometric view of a conventional belt-mounted vacuum 20. The belt-mounted vacuum 20 includes a housing 22 attached to a carrier belt 24. The housing 22 has a vacuum unit chamber 25 that typically includes a fan driven by an electric motor (not shown). The housing 22 also includes a bag chamber 26 that typically contains an inner bag (not shown) for receiving dust, dirt, and particulate matter. A vacuum hose 28 is coupled to an intake port 30 disposed in an openable cover 32 that leads to the bag chamber 26. An exhaust port 31 is disposed in the housing 22 and leads to the vacuum unit chamber 24.

In operation, the carrier belt 24 is fastened around the operator's waist with the housing 22 positioned along the operator's back. The housing 22 may have a bent or contoured shape to conform to the operator's body. The electric motor drives the fan which in turn drives air through the exhaust port 31 and creates suction within the bag chamber 26 and the vacuum hose 28. A flow of air is thereby drawn through the vacuum hose 28 and through the intake port 30, drawing dust, dirt, and particulates from the surface being cleaned into the bag chamber 26. The particle-laden airflow may then pass through the inner bag which filter's and collects the dust and particulates from the airstream for later disposal. The resulting clean airstream passes through the fan and exits through the exhaust port 31. Belt-mounted vacuums 20 of the type shown in FIG. 1 are disclosed, for example, in U.S. Pat. No. 4,944,065 issued to Svanberg et al.

Although desirable results may be achieved using conventional belt-mounted vacuums, some drawbacks exist. For example, the operator may attempt to compensate for the weight of the belt-mounted vacuum 20 on the operator's back by leaning forward into a hunched position. This may be uncomfortable and may cause additional stress or fatigue for the operator, especially after extended periods of use.

Also, when it is time to empty or change the inner bag, the operator typically must remove the belt-mounted vacuum 20 in order to reach the openable cover 32 of the bag chamber 26 in order to reach the inner bag. Thus, the belt-mounted vacuum 20 typically must be removed (and re-donned) each time the inner bag must be accessed. Alternately, the operator may attempt to enlist the assistance of another person, or may even resort to awkwardly sliding the belt 24 around his or her waist so that the housing 22 is moved around from the back side of the operator to a reachable position. These alternate approaches may reduce the efficiency and productivity of the operator, and may decrease the operator's satisfaction with the device.

Another disadvantage of conventional devices is that because the controls of the belt-mounted vacuum are typically located on or near the vacuum unit chamber 24, the operator may need to reach backwardly to the housing 20 in order to turn the vacuum on or off, or to adjust the power setting. This may be inconvenient and may further reduce the operator's satisfaction with the device.

SUMMARY OF THE INVENTION

The present invention is directed to belt-mounted vacuum apparatus and methods. In one aspect, a belt-mounted vacuum apparatus includes a belt member adapted to engage about an operator's waist, a dirt receptacle attached to the belt member and having an intake port, and a vacuum unit attached to the belt member and spaced apart from the dirt receptacle. The vacuum unit is operatively coupled with the dirt receptacle such that an airflow created by the vacuum unit propels particulates through the intake port and into the dirt receptacle. Because the vacuum unit is spaced apart from the dirt receptacle, the vacuum apparatus may advantageously provide improved balance and weight distribution, and may increase the operator's satisfaction with the device. In alternate aspects, the vacuum unit may be spaced apart from the dirt receptacle by a small distance, or may be positioned on opposite sides of the operator, or any other desired spacing.

In another aspect, a belt-mounted vacuum apparatus includes a belt member having a stiffened portion. The stiffened portion may, for example, comprise an outer shell. Alternately, the belt member may also include a flexible, padded layer that engages with the operator's waist. The stiffened portion may be disposed within the flexible layer. In another aspect, the belt member may include a plurality of stiffened portions.

In yet another aspect, a belt-mounted apparatus includes a belt member adapted to engage about the operator's waist, a dirt receptacle attached to the belt member and located at an accessible location on the belt member. The apparatus further includes a vacuum unit attached to the belt member and operatively coupled with the dirt receptacle such that an airflow created by the vacuum unit propels particulates through the intake port and into the dirt receptacle. In alternate aspects, the dirt receptacle may be located proximate a front side of the operator's waist, or along a left or right side of the operator's waist, or at any other accessible location on the belt member. Because the dirt receptacle is located at an accessible location, the belt-mounted vacuum apparatus may improve the efficiency and operability of the device.

DETAILED DESCRIPTION OF THE INVENTION

The present invention is generally directed to belt-mounted vacuum apparatus and methods. Many specific details of certain embodiments of the invention are set forth in the following description and in FIGS. 2–10 to provide a thorough understanding of such embodiments. One skilled in the art will understand, however, that the present invention may have additional embodiments, or that the present invention may be practiced without several of the details described in the following description.

Figure 1:
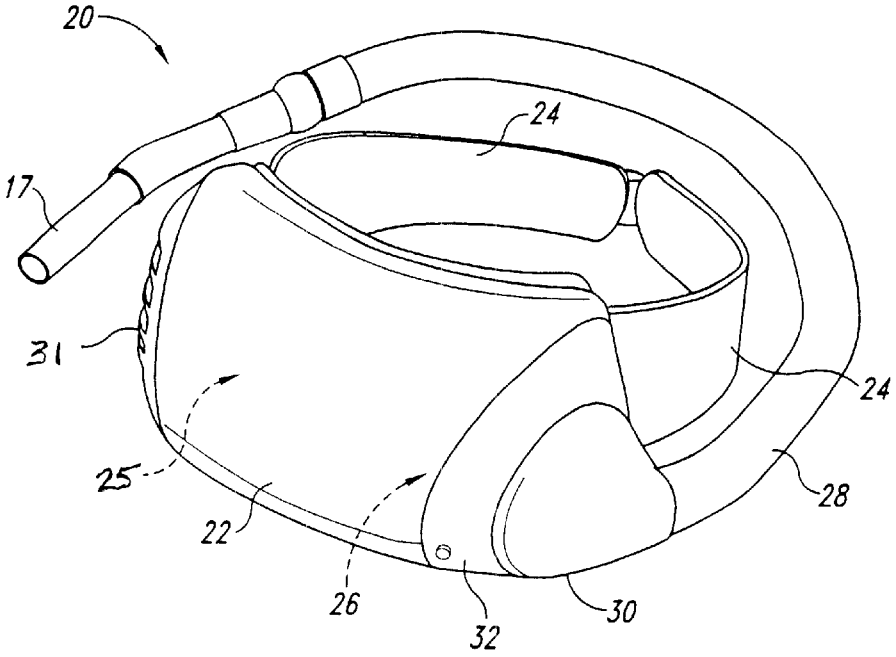
Fig. 1 (Prior Art)
FIG. 1 is an isometric view of a belt-mounted vacuum in accordance with the prior art.
Figure 2:
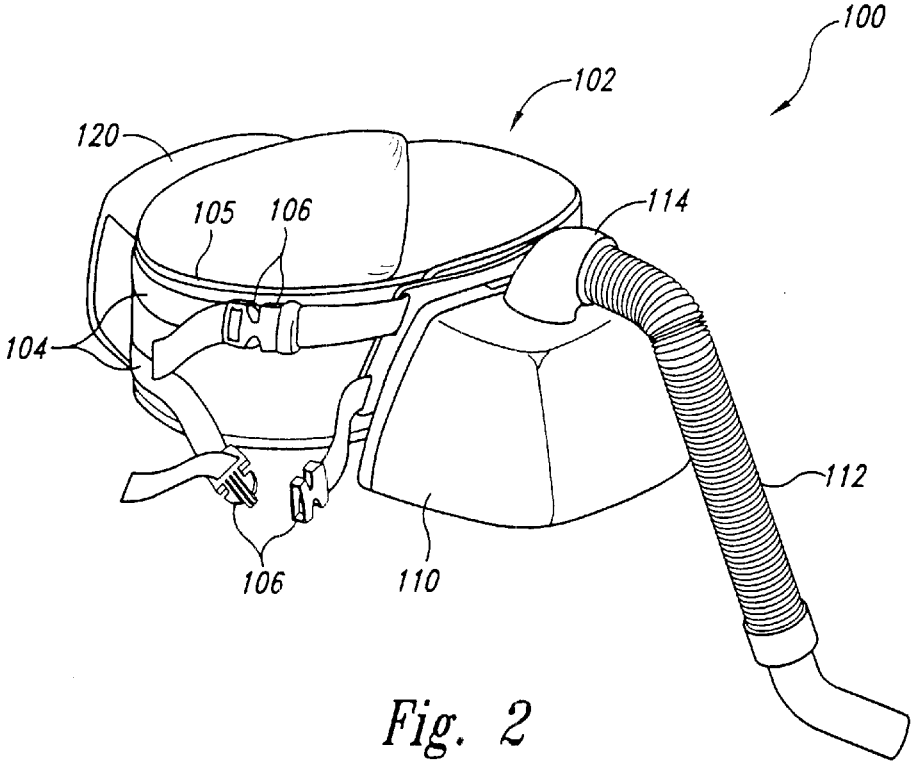
FIG. 2 is an isometric view of a belt-mounted vacuum in accordance with an embodiment of the invention.
Figure 3:
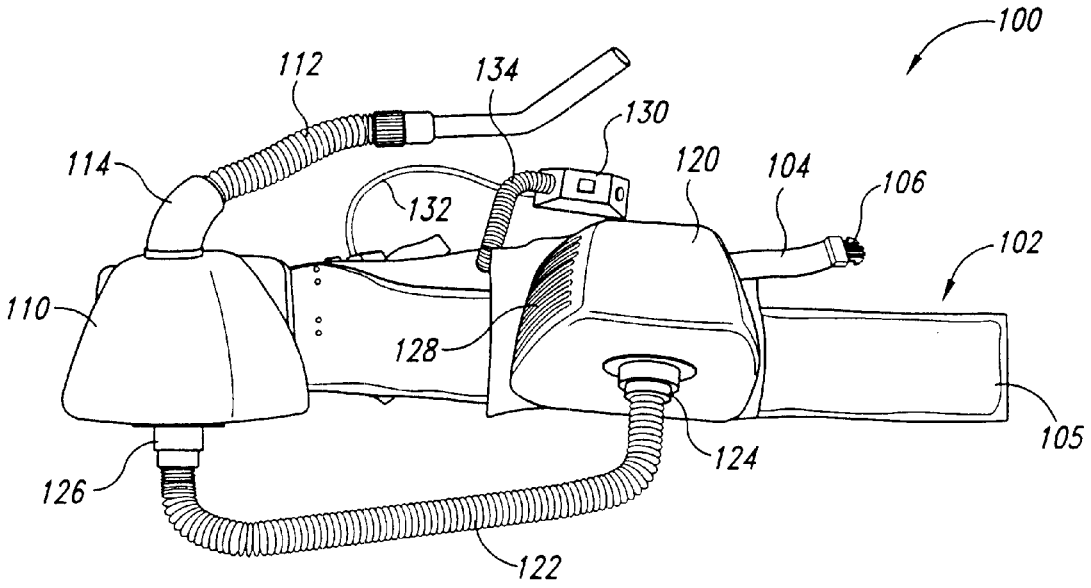
FIG. 3 is a side elevational view of the belt-mounted vacuum of FIG. 2.

FIGS. 2 and 3 are isometric and elevational views, respectively, of a belt-mounted vacuum 100 in accordance with an embodiment of the invention. The belt-mounted vacuum 100 includes a belt 102 adapted to engage about an operator's waist, a dirt receptacle 110 attached to the belt 102, and a vacuum unit 120 attached to the belt 102. The vacuum unit 120 consists of a separate unit from the dirt receptacle 110, and the vacuum unit 120 and dirt receptacle 110 are spaced apart from each other along the belt 102.

In the embodiment shown in FIG. 2, the belt 102 includes a pair of flexible straps 104 attached to an inner pad 105 that engages the operator's waist. Quick-disconnect couplings 106 are attached to the ends of the straps 104 which allow the belt 102 to be easily donned or removed. Alternately, the couplings 106 may be replaced with a wide variety of suitable attachment devices known to those of skill in the art, including buckles, buttons, snaps, hook-and-loop fasteners such as those sold under the trademark VELCRO®, or other similar devices.

An intake hose 112 is attached to a swivel assembly 114 that is fluidly coupled to an intake port 117 (FIG. 4) of the dirt receptacle 110. As shown in FIG. 3, an auxiliary hose 122 is coupled between a suction inlet 124 leading into the vacuum unit 120, and a suction outlet 126 leading out of the dirt receptacle 110. An exhaust vent 128 is disposed within a sidewall of the vacuum unit 120. A control unit 130 is electrically connected to the vacuum unit 120 by a control line 132. The control unit 130 is tethered to the belt 104 by a bungee 134 (FIG. 3). Power may be supplied to the vacuum unit 120 by a battery unit stowed within the vacuum unit 120, or alternately, by a power cord (not shown).

Figure 4:
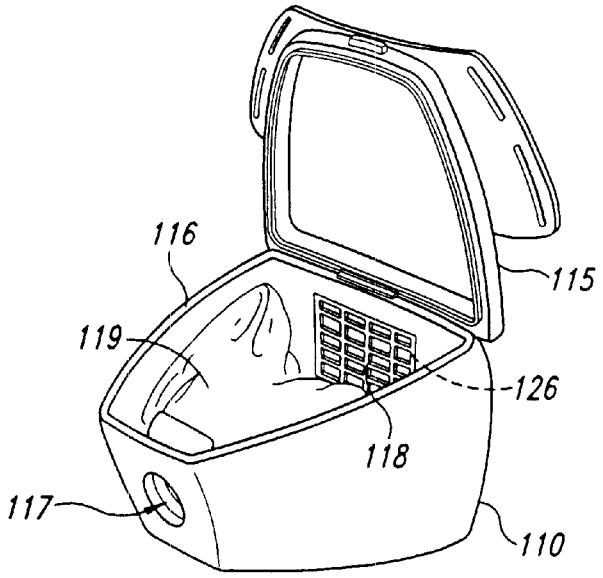
FIG. 4 is an isometric view of a dirt receptacle of the belt-mounted vacuum of FIG. 2.

FIG. 4 is an isometric view of the dirt receptacle 110 of the belt-mounted vacuum 100 of FIG. 2. The dirt receptacle 110 is shown in FIG. 4 in an open position. In this embodiment, the dirt receptacle 110 includes a mounting portion 115 that attaches to the belt 102, and a shell member 116 hingeably attached to the mounting portion 115. The intake port 117 and the suction outlet 126 (FIG. 3) are disposed through the shell member 116. An inner bag (or filter element) 119 may be mounted within the dirt receptacle 110 to filter and contain dirt and particulates entering the dirt receptacle 110 through the intake port 117. A dust filter 118 covers the suction outlet 126.

The belt-mounted vacuum 100 advantageously has a vacuum unit 120 that is separate from the dirt receptacle 110. Because the vacuum unit 120 is separate from the dirt receptacle 110, the vacuum unit 120 and dirt receptacle 110 may be spaced apart from each other along the belt 102. Thus, the belt-mounted vacuum 100 may provide a more even distribution of the weight of the apparatus around the operator's waist.

One may note that the vacuum unit 120 may be spaced apart from the dirt receptacle 110 any desire distance around the circumference of the belt 102, including on opposite sides of the operator. For example, as shown in FIG. 2, the vacuum unit 120 may be positioned approximately 180 degrees around the circumference of the belt 102 (i.e., opposite from) the dirt receptacle 110. In this configuration, the vacuum unit 120 may be positioned on one side of the operator (e.g., the operator's left side), and a dirt receptacle 110 may be positioned on the other side of the operator (e.g., the operator's right side). In one aspect, the vacuum unit 120 may be placed proximate the operator's back side, and dirt receptacle 110 may be positioned in a convenient location proximate the operator's front side. Because the belt-mounted vacuum 100 having the vacuum unit 120 spaced apart from the dirt receptacle 110 provides a more even, balanced weight distribution on the operator's waist and hips, the operator may be less likely to suffer from stress or fatigue. Also, the operator is less likely to hunch over to compensate for the weight of the belt-mounted vacuum 100, thereby improving the operator's satisfaction with the device. Desirable results may be achieved by having the vacuum unit 120 spaced apart from the dirt receptacle 110 along the belt 102 by even a small distance (e.g., a few inches or less).

Another advantage of the belt-mounted vacuum 100 is that the dirt receptacle 110 may be conveniently positioned within the operator's reach so that the operator may change the inner bag 119 or the filter element 118 without removing the belt-mounted vacuum 100. This aspect allows the operator to quickly and efficiently change the inner bag 119 or the filter element 118 without a time-consuming disruption to the operator's work schedule. The dirt receptacle 110 may, for example, be positioned anywhere along the front side of the operator so that the operator is not required to reach backwardly or twist around excessively in order to access the dirt receptacle 110. The dirt receptacle 110 need not be positioned at the center of the front side of the operator, but may be positioned at any accessible, conveniently-reachable location. For example, in alternate embodiments, the dirt receptacle 110 may be positioned anywhere along the front side of the operator, or along either the left or right side of the operator, or even slightly toward the back side of the operator. Thus, the dirt receptacle 110 may be positioned at a variety of accessible locations on the belt 102, wherein an accessible location is defined as a location that the operator may reach without removing the belt-mounted vacuum 100, and without the necessity of sliding the belt 102 around the operator's waist.

Yet another advantage of the belt-mounted vacuum 100 is that the control unit 130 is remotely connected to the vacuum unit 120 by the control line 132. Because the control unit 130 is removed from the vacuum unit 120, the operator may controllably adjust the vacuum unit 120 easily and efficiently with the vacuum unit 120 positioned anywhere along the belt 102. For example, with the vacuum unit 120 positioned along the operator's back side, the operator may actuate the control unit 130 to control the suction power of the vacuum unit 120, or to turn the vacuum unit 120 on or off, without reaching around or turning excessively in order to access the vacuum unit 120, and without removing the belt-mounted vacuum 100. Again, time-consuming interruptions of the operator's work schedule may be further reduced or eliminated.

Figure 5:
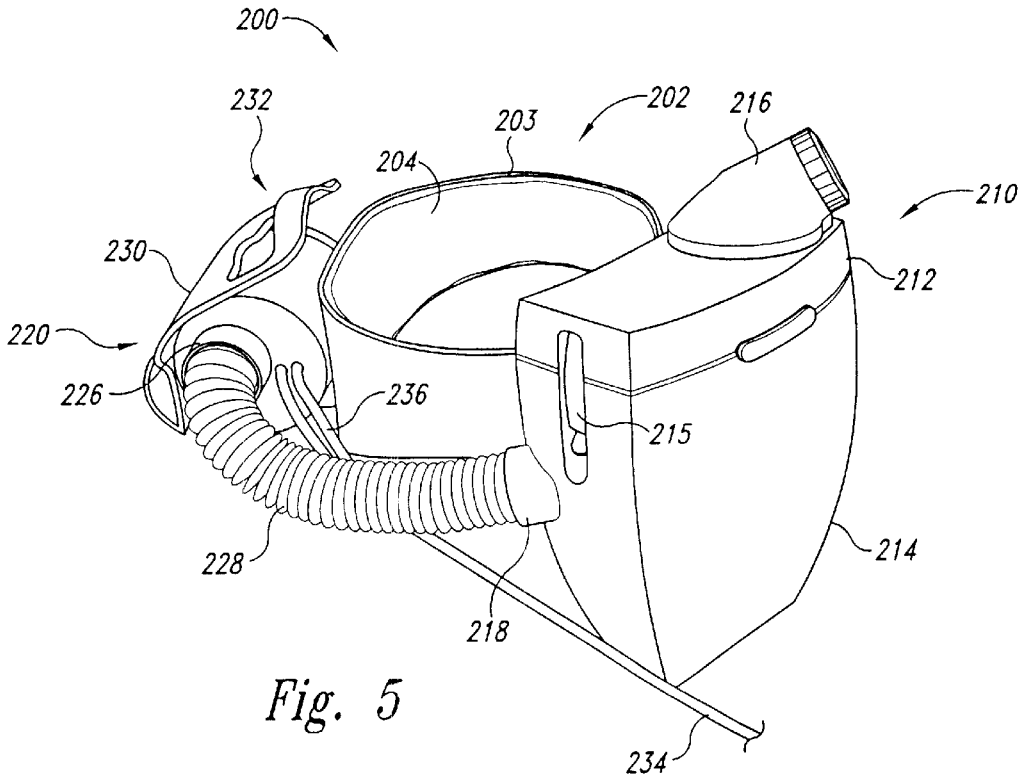
FIG. 5 is a side isometric view of a belt-mounted vacuum in accordance with an alternate embodiment of the invention.
Figure 6:
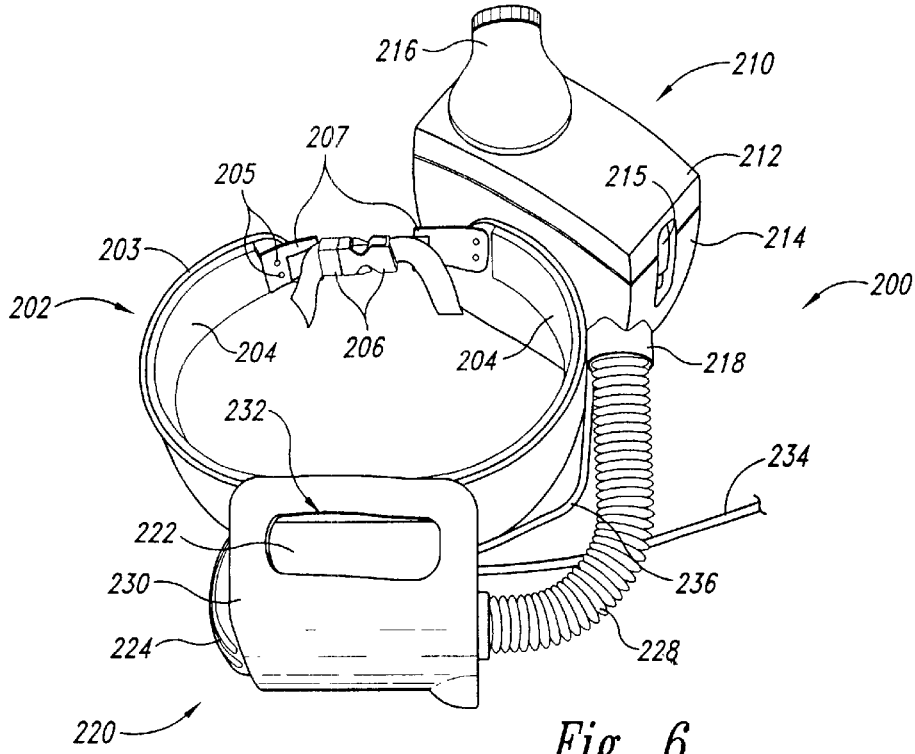
FIG. 6 is a back isometric view of the belt-mounted vacuum of FIG. 5.
Figure 7:
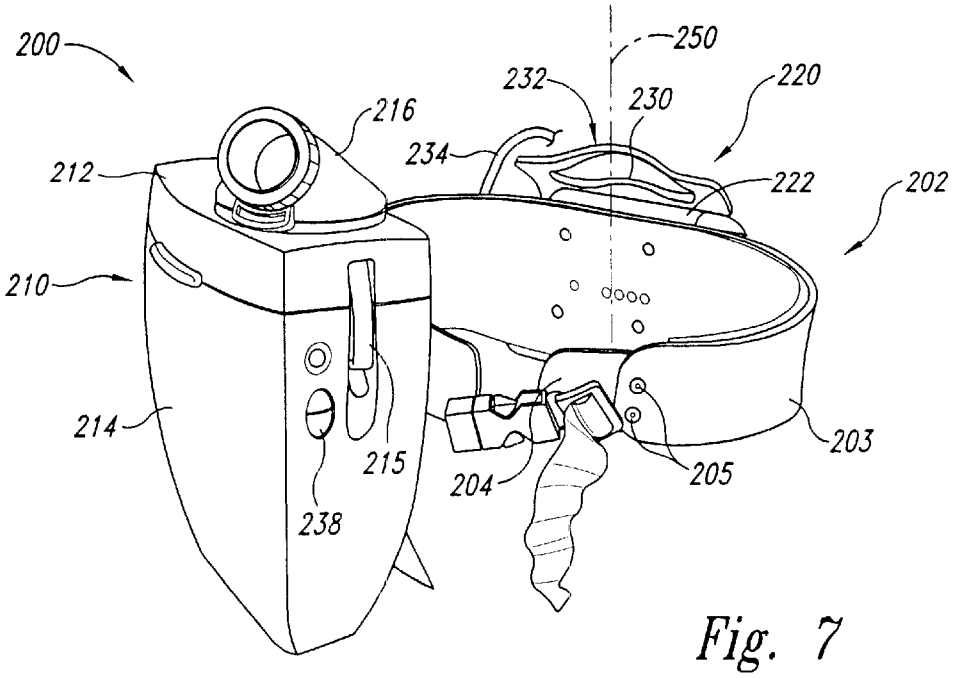
FIG. 7 is a front isometric view of the belt-mounted vacuum of FIG. 5.

FIG. 5 is a side isometric view of a belt-mounted vacuum 200 in accordance with an alternate embodiment of the invention. FIGS. 6 and 7 are back and front isometric views, respectively, of the belt-mounted vacuum 200 of FIG. 5. The belt-mounted vacuum 200 includes a belt member 202 having an outer, stiffened layer 203 and an inner flexible (or padded) layer 204. Flexible straps 207 are attached to the stiffened layer 203 by rivets 205 (FIG. 7), and connectors 206 are attached to the ends of the flexible straps 207 to allow the belt member 202 to be fastened around an operator's waist.

The belt-mounted vacuum 200 further includes a dirt receptacle 210 and a vacuum unit 220. The dirt receptacle 210 and the vacuum unit 220 are attached to the belt member 202 and are spaced apart from each other around the circumference of the belt member 202. As the shown in FIG. 6, with the connectors 206 centered along the front side of the operator, the vacuum unit 220 is centered along the back side of the operator, and a dirt receptacle 210 is located along the operator's front side at a position slightly offset to the operator's right side.

The dirt receptacle 210 includes a removable top portion 212 coupled to a container portion 214 by clips 215. An intake duct 216 is swivelably (or rotatably) coupled to an intake aperture 217 (not shown) disposed in the top portion 212. A suction outlet 218 is disposed in the container portion 214.

The vacuum unit 220 includes a housing 222 having an electric motor that drives a suction fan (not shown). An exhaust vent 224 (partially shown in FIG. 6) is disposed in one end of the housing 222. A suction inlet 226 is also disposed in the housing 222. A suction duct (or conduit) 228 is fluidly coupled between the suction inlet 226 of the vacuum unit 220 and the suction outlet 218 of the dirt receptacle 210. A shield 230 is disposed about the casing 222 of the vacuum unit 220 to protect the casing 222 from blows that might otherwise damage the vacuum unit's suction fan or motor. A carrying handle 232 is disposed in the shield 230. A power cord 234 is connected to the casing 222 to provide power to the electric motor. In alternate embodiments, the power cord 234 may be eliminated, and the vacuum unit 220 may be battery-powered. A control cable 236 is coupled between the casing 222 and the dirt receptacle 210. A control switch 238 (FIG. 7) is located on the container portion 214 of the dirt receptacle 210 for adjustably controlling the vacuum unit 220.

Figure 8:
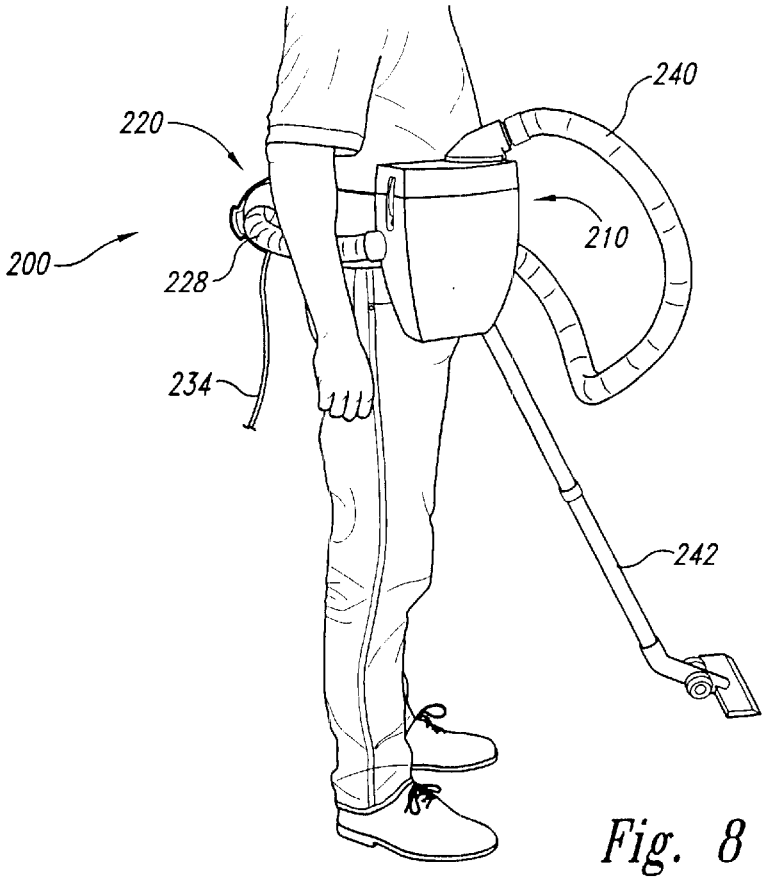
FIG. 8 is a side elevational view of the belt-mounted vacuum of FIG. 5 being worn by an operator.

FIG. 8 is a side elevational view of the belt-mounted vacuum 200 of FIG. 5 being worn by an operator. As shown in FIG. 8, the belt member 202 may be fastened around the operator's waist with the dirt receptacle 210 positioned along the front side of the operator, and the vacuum unit 220 centered along the operator's back side. A vacuum hose 240 may be coupled to the intake duct 216 and to a vacuum attachment 242 for cleaning a surface (e.g. a floor).

Figure 9:
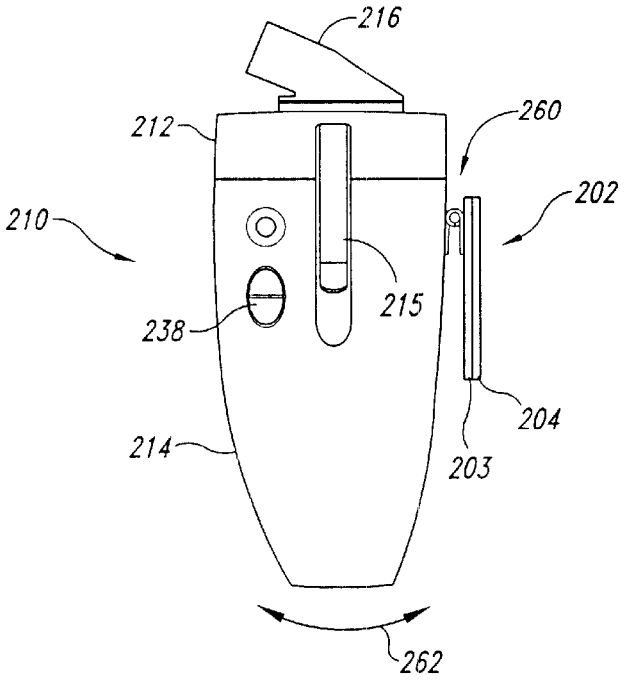
FIG. 9 is a side elevational view of a dirt receptacle attached to a belt member by a hinge.

As shown in FIG. 8, the dirt receptacle 210 may be positioned over a portion of the operator's right (or left) leg, or may cover one of the pockets of the operator's clothing. To provide improved access or improved freedom of movement, the dirt receptacle 210 may be pivotably or hingeably attached to the belt member 202. FIG. 9 is a side elevational view of the dirt receptacle 210 attached to the belt member 202 by a hinge 260. The hinge 260 allows the dirt receptacle 210 to pivot back and forth as indicated by arrow 262 as the operator moves or walks, or to allow the operator to access his or her pocket. Of course, the vacuum unit 220 may also be pivotably or hingeably attached to the belt member 202.

The belt-mounted vacuum 200 may advantageously provide the desirable features described above, and may also provide improved comfort and convenience for the operator. Because the belt member 202 includes an outer stiffened layer 203, the belt-mounted vacuum 200 may more evenly distribute the weight of the vacuum unit 220 and the dirt receptacle 210 on the operator's waist and hips. This may advantageously improve the comfort of the belt member 202 in comparison with flexible belts, thereby improving the operator's satisfaction with the device and allowing the operator to operate the device comfortably for extended periods. Also, because the stiffened layer 203 is relatively stiff, the ease of handling and storage of the belt-mounted vacuum 200 may be improved compared with belt-mounted vacuums having entirely flexible belts.

The stiffened layer 203 may be fabricated from a variety of materials, including plastic, leather, fiberglass, or other suitable materials. Although the stiffened layer 203 is shown as forming an outer surface of the belt member 202, it should be understood that the stiffened layer 203 may be disposed within the flexible layer 204. In an alternate aspect, the flexible layer 204 may be eliminated, and the belt member 202 may consist solely of the stiffened (or "shell ") layer 203. Furthermore, the stiffened layer 203 need not be a unitary piece, but rather, may be segmented. For example, as shown in FIG. 7, the stiffened layer 203 may be divided along dividing line 250, resulting in two segments of the stiffened layer 203. The resulting segments may, for example, be joined by the vacuum unit 220, the flexible layer 204, or by other suitable means. Alternate, multi-segmented embodiments are also readily conceivable.

Another advantage of the belt-mounted vacuum 200 is that the inner flexible layer 204 may absorb vibration and heat emanating from the motor of the vacuum unit 220, thereby improving the operator's comfort and satisfaction with the device. Preferably, the inner flexible layer 204 is a resilient, compressible layer that conforms to the shape of the operator's body. The flexible layer 204 may, of course, be composed of a variety of materials, including rubber, nylon, foam, synthetic or natural fibers, or other suitable materials.

Figure 10:
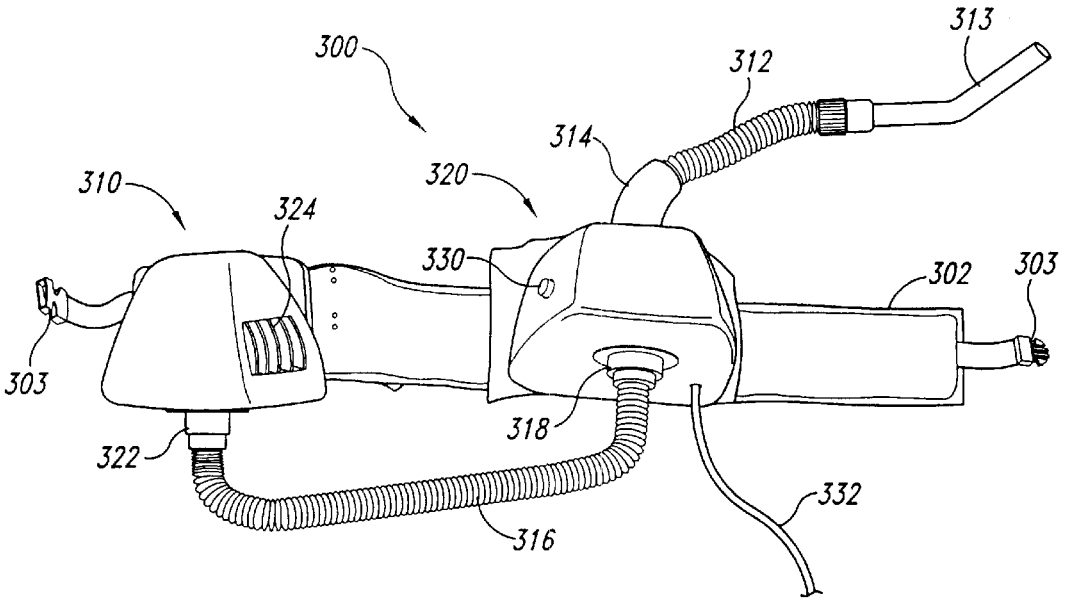
FIG. 10 is a side elevational view of a belt-mounted vacuum in accordance with yet another embodiment of the invention.

FIG. 10 is a side elevational view of a belt-mounted vacuum 300 in accordance with yet another embodiment of the invention. In this embodiment, the belt-mounted vacuum 300 includes a dirt receptacle 310 attached to a belt 302, and a vacuum unit 320 attached to the belt 302 and spaced apart from the dirt receptacle 310. An intake hose 312 having an open end 313 is coupled to an inlet port 314 of the vacuum unit 320. A dirty-air conduit 316 is coupled between an outlet port 318 of the vacuum unit 320, and a dirty-air inlet 322 of the dirt receptacle 310. An exhaust port 324 is disposed in the dirt receptacle 310. The belt 302 includes connectors 303 for clasping the ends of the belt 302 together about an operator's waist. A control switch 330 is positioned on the vacuum unit 320, and a power cord 332 provides power to the vacuum unit 320.

In operation, the operator puts on the belt-mounted vacuum 300 and positions the open end 313 of the intake hose 312 proximate a surface to be cleaned. The vacuum unit 320 creates a suction airflow that draws dirt, dust, and particulates into the open end 313 and through the intake hose 312. The particle-laden airstream enters the inlet port 314, passes through the vacuum unit 320, and exits through the outlet port 318. The particle-laden airstream continues through the dirty-air conduit 316 and enters the dirty-air inlet 322 of the dirt receptacle 310. The particle-laden airstream may then pass through a filter, such as a conventional vacuum bag, which filters the dirt, dust, and particulates from the particle-laden airstream. A resulting clean airstream exits the dirt receptacle 310 through the exhaust port 324.

An advantage of the belt-mounted vacuum 300 is that the vacuum unit 320 is positioned between the dirt receptacle 310 and the intake hose 312. This configuration may provide improved suction efficiency at the opening 313 of the intake hose 312 compared with alternate embodiments described above. Thus, the greater suction force may be obtained at the opening 313. Alternately, the smaller, more lightweight vacuum unit 320 may be used. Because the vacuum unit 320 is spaced apart from the dirt receptacle 310 along the belt 302, the above described advantages of improved weight distribution, balance, and ease and satisfaction of use may be achieved.

It should be noted that the belt-mounted vacuum 300 (like the previously described embodiments) may be positioned on the operator's waist in a wide variety of orientations, including with either the vacuum unit 320 or the dirt receptacle 310 located along the operator's front side, and the other of the vacuum unit 320 or the dirt receptacle 310 located along the operator's back side. Alternately, the vacuum unit 320 and the dirt receptacle 310 may be positioned on opposing lateral sides of the operator. The vacuum unit 320 need not be positioned on an opposite side of the operator from the dirt receptacle 310. As stated above, having the vacuum unit 320 spaced apart from the dirt receptacle 310 along the belt 302 by even a small distance (e.g., a few inches or less) may improve the weight distribution and balance of the belt-mounted vacuum 300 in comparison with conventional devices.

The detailed descriptions of the above embodiments are not exhaustive descriptions of all embodiments contemplated by the inventors to be within the scope of the invention. Indeed, persons skilled in the art will recognize that certain elements of the above-described embodiments may variously be combined or eliminated to create further embodiments, and such further embodiments fall within the scope and teachings of the invention. It will also be apparent to those of ordinary skill in the art that the above-described embodiments may be combined in whole or in part to create additional embodiments within the scope and teachings of the invention.

Thus, although specific embodiments of, and examples for, the invention are described herein for illustrative purposes, various equivalent modifications are possible within the scope of the invention, as those skilled in the relevant art will recognize. The teachings provided herein can be applied to other belt-mounted vacuum apparatus and methods, and not just to the embodiments described above and shown in the accompanying figures. Accordingly, the scope of the invention should be determined from the following claims.

What is claimed is:

1. A vacuum apparatus adapted to be worn by an operator having a front side and a back side, comprising:

a belt member adapted to engage about the operator;

a dirt receptacle attached to the belt member and having an intake port; and a vacuum unit attached to the belt member and operatively coupled with the dirt receptacle such that an airflow created by the vacuum unit propels particulates through the intake port and into the dirt receptacle, the vacuum unit and the dirt receptacle being spaced apart on the belt member and adapted such that when the belt member is engaged about the operator, either the vacuum unit or the dirt receptacle is proximate the front side of the operator and the other of the vacuum unit or the dirt receptacle is proximate the back side of the operator.

2. The vacuum apparatus according to claim 1 wherein the vacuum unit is spaced apart from the dirt receptacle by a small distance.

3. The vacuum apparatus according to claim 1 wherein when the belt member is engaged about the operator, the vacuum unit is proximate the back side of the operator.

4. The vacuum apparatus according to claim 1 wherein when the belt member is engaged about the operator, the dirt receptacle is proximate the front side of the operator.

5. The vacuum apparatus according to claim 1 wherein the dirt receptacle includes a suction outlet and the vacuum unit includes a suction inlet operatively coupled to the suction outlet by a conduit, the vacuum unit creating a suction within the dirt receptacle that draws particulates through the intake port and into the dirt receptacle.

6. The vacuum apparatus according to claim 1 wherein the vacuum unit includes a suction inlet and a dirty-air outlet, the dirty-air outlet being operatively coupled to the intake port of the dirt receptacle by a conduit, the vacuum unit drawing particulates through the suction inlet and propelling the particulates through the conduit into the intake port.

7. The vacuum apparatus according to claim 1 wherein the dirt receptacle includes an inner bag.

8. The vacuum apparatus according to claim 1 wherein the dirt receptacle includes an inner bag.

9. The vacuum apparatus according to claim 1 wherein the belt member includes a stiffened portion and an inner flexible portion adapted to be engageable with the operator.

10. The vacuum apparatus according to claim 1 wherein the intake port includes a swivel assembly.

11. The vacuum apparatus according to claim 1, further comprising a power cord operatively connected to the vacuum unit.

12. A vacuum apparatus adapted to be worn by an operator, comprising:

a belt member adapted to engage about the operator, the belt member having a stiffened portion;

a dirt receptacle attached to the belt member and having an intake port; and a vacuum unit attached to the belt member and operatively coupled with the dirt receptacle such that an airflow created by the vacuum unit propels particulates through the intake port and into the dirt receptacle.

13. The vacuum apparatus according to claim 12 wherein the belt member includes a flexible portion coupled to the stiffened portion and adapted to be engageable with the operator.

14. The vacuum apparatus according to claim 12 wherein the stiffened portion comprises an outer shell and wherein the belt member includes an inner flexible portion coupled to the outer shell and adapted to be engageable with the operator.

15. The vacuum apparatus according to claim 12 wherein the stiffened portion comprises a plastic portion.

16. The vacuum apparatus according to claim 12 wherein the vacuum unit is spaced apart from the dirt receptacle.

17. The vacuum apparatus according to claim 12 wherein the vacuum unit is spaced apart from the dirt receptacle to a position that is substantially opposite from the dirt receptacle on the belt member.

18. The vacuum apparatus according to claim 12 wherein the belt member includes a front portion adapted to at least partially engage with a front side of the operator, the dirt receptacle being attached to the front portion.

19. A vacuum apparatus adapted to be worn by an operator having a front side and a back side, comprising:

a belt member adapted to engage about the operator;

a dirt receptacle attached to the belt member and located at an accessible location on the belt member, the dirt receptacle having an intake port; and a vacuum unit attached to the belt member and operatively coupled with the dirt receptacle such that an airflow created by the vacuum unit propels particulates through the intake port and into the dirt receptacle, the vacuum unit and the dirt receptacle being spaced apart on the belt member and adapted such that when the belt member is engaged about the operator, either the vacuum unit or the dirt receptacle is proximate the front side of the operator and the other of the vacuum unit or the dirt receptacle is proximate the back side of the operator.

20. The vacuum apparatus according to claim 19 wherein the belt member includes a front portion adapted to be proximate the front side of the operator and the accessible location comprises a location disposed along the front portion.

21. The vacuum apparatus according to claim 19 wherein the accessible location comprises a location adapted to be along a left or right side of the operator.

22. The vacuum apparatus according to claim 19 wherein the vacuum unit is spaced apart from the dirt receptacle by a small distance.

23. The vacuum apparatus according to claim 19 wherein the dirt receptacle includes a suction outlet and the vacuum unit includes a suction inlet operatively coupled to the suction outlet, the vacuum unit creating a suction within the dirt receptacle that draws particulates through the intake port and into the dirt receptacle.

24. A method of operating a belt-mounted vacuum engaged about an operator having a front side and a back side, comprising:

engaging a belt about an operator;

generating a suction airflow at a suction inlet of a vacuum unit;

drawing a particle-laden airflow through an intake port of a dirt receptacle;

filtering the particle-laden airflow; and drawing the suction airflow through a conduit coupled between a suction outlet of the dirt receptacle and the suction inlet of the vacuum unit, wherein drawing the suction airflow through a conduit comprises drawing the suction airflow through a conduit from a first location on the belt proximate the front side of the operator to a second location on the belt proximate the back side of the operator.

25. The method of claim 24 wherein drawing the suction airflow through a conduit comprises drawing the suction airflow through a conduit from a first location to a second location, the second location being spaced apart from the first location.

26. The method of claim 24, further comprising positioning the dirt receptacle at an accessible position.

27. The method of claim 24, further comprising positioning the dirt receptacle at a position along a front side of the operator's waist.

28. The method of claim 24, further comprising positioning the dirt receptacle at a position along a left or right side of the operator's waist.

29. A method of operating a belt-mounted vacuum engaged about an operator having a front side and a back side, comprising:

engaging a belt about an operator;

drawing a particle-laden airflow through an intake port of a vacuum unit;

propelling the particle-laden airflow from the vacuum unit through a conduit into a dirt receptacle, wherein propelling the particle-laden airflow through a conduit comprises propelling the particle-laden airflow through a conduit from a first location on the belt proximate the front side of the operator to a second location on the belt proximate the back side of the operator; and filtering the particle-laden airflow.

30. The method of claim 29 wherein propelling the particle-laden airflow from the vacuum unit through a conduit into a dirt receptacle comprises propelling the particle-laden airflow through a conduit from a first location to a second location, the second portion being spaced apart from the first portion.

31. The method of claim 29, further comprising positioning the dirt receptacle at an accessible position.

32. The method of claim 29, further comprising positioning the dirt receptacle at a position along a front side of the operator's waist.

33. The method of claim 29, further comprising positioning the dirt receptacle at a position along a left or right side of the operator's waist.

* * * * *

UNITED STATES PATENT AND TRADEMARK OFFICE

CERTIFICATE OF CORRECTION

PATENT NO. : 6,473,933 B2
DATED : November 5, 2002
INVENTOR(S) : Paterson, Christopher M. et al.

It is certified that error appears in the above-identified patent and that said Letters Patent is hereby corrected as shown below:

Title page,
Item [75], Inventors, replace "Christopher M. Paterson, Long Beach, MS (US); Paul A. Moshenrose, Ocean Springs, MS (US); William G. Fish, Gulfport, MS (US); James McCain, Long Beach, MS (US); Charles W. Reynolds, Long Beach, MS (US); Michael E. Embree, Providence, RI (US)" with -- Christopher M. Paterson, Long Beach, MS (US); Paul A. Moshenrose, Ocean Springs, MS (US); William G. Fish, Gulfport, MS (US); James McCain, New Orleans, LA (US); Charles W. Reynolds, Long Beach, MS (US); Michael E. Embree, Providence, RI (US) --

Signed and Sealed this

Eighteenth Day of March, 2003

JAMES E. ROGAN
*Director of the United States Patent and Trademark Office*